US011618994B2

(12) United States Patent
Lavery

(10) Patent No.: US 11,618,994 B2
(45) Date of Patent: Apr. 4, 2023

(54) INTEGRATED STRAINER AND CONTAINER FOR SOAKING CLOTHES AND THE LIKE

(71) Applicant: MANGO STREET HOLDINGS PTY LTD, Buderim (AU)

(72) Inventor: Kelly Lavery, Buderim (AU)

(73) Assignee: Mango Street Holdings Pty Ltd, Brisbane (AU)

( * ) Notice: Subject to any disclaimer, the term of this patent is extended or adjusted under 35 U.S.C. 154(b) by 460 days.

(21) Appl. No.: 16/618,377

(22) PCT Filed: Jun. 1, 2018

(86) PCT No.: PCT/AU2018/050540
§ 371 (c)(1),
(2) Date: Dec. 1, 2019

(87) PCT Pub. No.: WO2018/218304
PCT Pub. Date: Dec. 6, 2018

(65) Prior Publication Data

US 2020/0291569 A1 Sep. 17, 2020

(30) Foreign Application Priority Data

Jun. 2, 2017 (AU) ..... 2017902114

(51) Int. Cl.

| | |
|---|---|
| ***D06F 95/00*** | (2006.01) |
| ***D06F 1/02*** | (2006.01) |
| ***B65D 25/28*** | (2006.01) |
| ***D06F 1/12*** | (2006.01) |

(52) U.S. Cl.
CPC ..... *D06F 95/002* (2013.01); *D06F 1/02* (2013.01); *B65D 25/2888* (2013.01); *D06F 1/12* (2013.01)

(58) Field of Classification Search
CPC . D06F 95/002; D06F 1/02; D06F 1/12; B65D 25/2888
USPC ..... 232/1 B
See application file for complete search history.

(56) References Cited

U.S. PATENT DOCUMENTS

| | | | |
|---|---|---|---|
| 405,509 | A | 6/1889 | Smith |
| 421,253 | A | 2/1890 | Dore |
| 459,549 | A | 9/1891 | Jones |
| 917,552 | A | 4/1909 | Daniels |

(Continued)

FOREIGN PATENT DOCUMENTS

| | | |
|---|---|---|
| CN | 86203158 | 5/1986 |
| EP | 2091498 | 12/2007 |

(Continued)

OTHER PUBLICATIONS

Written Opinion of the International Searching Authority (PCT/ISA/237) in corresponding international application case (PCT/AU2018/050540).

*Primary Examiner* — Stephen M Gravini
(74) *Attorney, Agent, or Firm* — Bonini IP Law, LLC; Frank J. Bonini, Jr.

(57) ABSTRACT

An integrated strainer and container includes a strainer with a plurality of openings in at least one wall thereof and at least one engagement foot; and the container for holding a liquid and having an open top, configured to receive the strainer within in a soaking position, the container having an upper structure configured to engage at least one engagement foot to hold the strainer relative to the upper structure in a raised, drainage position.

15 Claims, 12 Drawing Sheets

(56) References Cited

U.S. PATENT DOCUMENTS 965,611 A 7/1910 Tucker
979,380 A 12/1910 Clay
1,023,645 A * 4/1912 Hamilton ..... A47J 37/1295 99/410
1,051,735 A 1/1913 Hammond
1,163,940 A 12/1915 Meyer
1,298,503 A 3/1919 Holder
2,016,550 A 10/1935 Kirby
2,070,998 A 2/1937 Odom
2,250,646 A 7/1941 Metsch
2,319,384 A * 5/1943 Callan ..... D06F 95/004 141/390
2,557,613 A 6/1951 Palensky
2,625,270 A 1/1953 Armas
2,630,938 A 3/1953 Burnett
2,753,436 A * 7/1956 Schwaneke ..... A47J 37/1209 99/403
D185,399 S 6/1959 Tupper et al.
3,331,309 A 7/1967 Proffitt
3,487,989 A 1/1970 Rausing et al.
3,508,485 A * 4/1970 Munsey ..... H05B 1/0213 219/442
3,819,045 A * 6/1974 Greenwald ..... A61B 10/0038 436/178
4,122,973 A 10/1978 Ahern
4,189,386 A * 2/1980 Aman ..... B01D 29/117 210/264
4,966,697 A 10/1990 Rosaen
5,059,319 A 10/1991 Welsh
D362,804 S 10/1995 Warren
5,775,204 A * 7/1998 Link ..... A47J 31/0615 99/323
6,227,401 B1 5/2001 Rowland et al.
6,247,600 B1 6/2001 Sullivan, Jr.
6,436,286 B1 8/2002 Scott
6,719,216 B2 * 4/2004 Hubmann ..... B05B 7/244 239/375
6,736,969 B2 5/2004 Milne
7,044,292 B2 5/2006 Nall
7,159,734 B1 1/2007 O'Brien
7,210,401 B1 * 5/2007 Rolfes ..... A47J 31/368 99/302 R
D579,616 S 10/2008 Li
D618,414 S 6/2010 Bechtold, Jr.
8,707,859 B2 * 4/2014 Difante ..... A47J 36/20 99/413
9,162,240 B2 10/2015 Gerson et al.
10,196,169 B2 * 2/2019 Tsui ..... D06F 95/002
11,053,624 B2 * 7/2021 Farrington ..... D06F 37/30
2003/0089653 A1 5/2003 Scarano
2006/0226066 A1 10/2006 Mir
2006/0254976 A1 11/2006 Cooper
2007/0137497 A1 * 6/2007 Savage ..... A47J 37/1223 99/403
2009/0169756 A1 7/2009 Joosten
2010/0187234 A1 7/2010 Saranga
2011/0226771 A1 9/2011 Manne et al.
2011/0247504 A1 10/2011 Zangrande et al.
2012/0174798 A1 * 7/2012 Kulikowski ..... A47J 43/22 99/340
2013/0074702 A1 3/2013 Difante
2013/0139707 A1 6/2013 Walling, III
2015/0001284 A1 * 1/2015 Hegarty ..... D06F 95/002 232/1 B
2015/0048093 A1 2/2015 Aki
2017/0006987 A1 1/2017 Clough
2020/0291569 A1 * 9/2020 Lavery ..... D06F 95/002
2020/0375226 A1 * 12/2020 Dobizl ..... A23L 3/3589
2022/0098779 A1 * 3/2022 Coney ..... D06F 95/00
2022/0112653 A1 * 4/2022 Bixby ..... D06F 95/008

FOREIGN PATENT DOCUMENTS

GB 190306863 1/1904
GB 190710461 4/1908
GB 191514902 3/1916
GB 577267 5/1946
GB 2577224 A * 3/2020 ..... D06F 1/02
WO 2008076380 A2 6/2008
WO WO-2018218304 A1 * 12/2018 ..... D06F 1/02

* cited by examiner

INTEGRATED STRAINER AND CONTAINER FOR SOAKING CLOTHES AND THE LIKE

TECHNICAL FIELD

The present invention relates generally to the field of containers for holding liquids and particularly to a combination strainer and container to allow a user to soak items and then remove the items from the soak liquid quickly, easily and safely by elevating the strainer above the container to separate the items from the soak liquid.

BACKGROUND ART

Straining devices are known, particularly in situations where a user may wish to separate items from a liquid.

There are times however where such straining devices are not commonly available. One such example of this may occur in the domestic environment where for example clothing items are soaked in a soaking liquid or mixture. Over time, the removal of the unwanted material from the clothing items being soaked impregnated these into the soaking liquid or mixture to the extent that a user may not wish to touch or come into contact with the soaking liquid or mixture.

Normally, this will occur in a bucket or tub and the user will have to remove the soaked clothing items from the then charged soaking liquid or mixture by either draining the bucket or tub or manual removal of the clothing items from the charged soaking liquid or mixture. This is normally accomplished using some form of tool but may result in the wet and sometimes heavy clothing items being dropped for example.

It would therefore be a significant contribution to the art if an integrated strainer container be provided with a soaking container capable of containing a soaking liquid or mixture and in which items can be placed into the strainer container such that separation of the soaked items from the charged soaking liquid or mixture could be achieved simply by removal of the strainer container from the container holding the soaking liquid or mixture.

It will be clearly understood that, if a prior art publication is referred to herein, this reference does not constitute an admission that the publication forms part of the common general knowledge in the art in Australia or in any other country.

SUMMARY OF INVENTION

The present invention is directed to an integrated strainer and container for soaking clothes and the like, which may at least partially overcome at least one of the abovementioned disadvantages or provide the consumer with a useful or commercial choice.

With the foregoing in view, the present invention in one form, resides broadly in an integrated strainer and container for soaking clothes and the like, the integrated strainer and container including a) a strainer container with a plurality of openings in at least one wall thereof and a number of toggle feet movably mounted to the strainer container between a locked condition in which each of the toggle feet are held to the strainer container and a released condition in which the toggle feet extend from the strainer container; and b) a container for holding a liquid and having an open top, configured to receive the strainer container, the container having a lower internal structure configured to engage each of the toggle feet when the strainer container is fully inserted into the container to move the toggle feet to the released condition and an upper internal structure configured to engage each of the released toggle feet to hold the strainer container relative to the upper internal structure.

In an alternative aspect, the present invention resides in an integrated strainer and container for soaking clothes and the like, the integrated strainer and container including a) a strainer container with a plurality of openings in at least one wall thereof and a number of toggle feet movably mounted to the strainer container between a rest condition in which each of the toggle feet are adjacent to the strainer container and a released condition in which the toggle feet extend laterally from the strainer container; and b) a container for holding a liquid and having an open top, configured to receive the strainer container, the container having an upper internal structure configured to engage each of the released toggle feet to hold the strainer container relative to the upper internal structure.

In a further alternative aspect, the present invention resides in an integrated strainer and container for soaking clothes and the like, the integrated strainer and container including:

a) a strainer with a plurality of openings in at least one wall thereof and at least one engagement foot; and b) a container for holding a liquid and having an open top, configured to receive the strainer within in a soaking position, the container having an upper structure configured to engage at least one engagement foot to hold the strainer relative to the upper structure in a raised, drainage position.

The present invention can be used in either a domestic application or a commercial application. In use, the user will lift the strainer in to an elevated position at least partially above the container and then position the strainer relative to the container to separate the strainer from the soak liquid and allow the soak liquid to drain back into the container. If manufactured from appropriate materials, such as metal, of which stainless steel is particularly preferred, this will also allow the container to be placed on a heat source for example and still allow operation of the strainer.

In a preferred embodiment, each of the toggle feet may be biased into the released condition and held temporarily in the locked condition magnetically against a biasing force. In this configuration, once released, the toggle feet will not then collapse into the locked condition, which may occur under gravity or if the toggle feet are accidentally bumped for example. In this configuration, the toggle feet will preferably require determined return to the locked condition requiring that the biasing force be overcome, typically manually by a user. In this configuration, the magnetic force is typically great enough that once the toggle foot is in the locked condition against the biasing force, to hold each of the toggle feet in the locked condition until engaged by the lower internal structure to move each of the toggle feet to the released condition.

The present invention includes strainer container with a plurality of openings in at least one wall thereof and a number of toggle feet movably mounted to the strainer container between a locked condition, in which each of the toggle feet are magnetically held to the strainer container and a released condition, in which the toggle feet extend from the strainer container.

Any material or combination of materials can be used to form the strainer container but a plastic material is particularly preferred. In other embodiments, alternative materials could be used for different applications. For example, whilst plastic will preferable be used of the laundry soaking and draining applications, a metal material such as stainless steel could be used for the strainer container and a metal used for the container to allow the device of the present invention to be used in cooking for example boiling food items in the container on a stove or similar.

The strainer container can have any shape but it is preferred that the shape of the strainer container will correspond to that of the container into which it is at least partially received. However, the shapes may not necessarily correspond provided that the strainer container can be at least partially received into the container.

The strainer container will preferably have a substantially planar base wall and at least one sidewall upstanding, generally perpendicularly relative to the base wall. The particular number of sidewalls included in the strainer container will depend upon the shape of the strainer container, for example a rectangular strainer container usually having four upstanding sidewalls but a circular strainer container generally having a single upstanding sidewall.

The strainer container will normally be provided with at least one, and normally at least a pair of handles in order to allow a user to grasp of the strainer container to move the strainer container relative to the container. The handles will typically be opposed. Each of the handles will preferably be provided as an opening in an upper portion of a sidewall in order to allow to insert their fingers into the openings in order to grasp the strainer container. Preferably, when the strainer container is inserted into the container, the preferred handles will be positioned above an upper terminus of the walls of the container to allow a user to access the handles of the strainer container even when the strainer container is fully inserted into the container.

The strainer container will normally be provided with a number of openings in the at least one wall portion in order to allow items placed into the strainer container to be retained in the strainer container but to allow liquid to escape from strainer container when required. One or more openings may be provided in the base wall of the strainer container. The openings will therefore normally be liquid drain openings and may have any shape and there may be any number of openings provided in any of the one or more walls and/or base wall. Typically, groups of openings will be provided with solid wall portions in between for strength. For example, in a particularly preferred embodiment where the strainer container is substantially rectangular, each of the sidewalls will normally have a regular array of openings therein, with preferably solid arcuate corner portions between the respective sidewalls to provide strength to the strainer container. One or more openings may be provided in the base wall if desired.

Preferably, the at least one wall of the strainer container will diverge outwardly from the base wall as the at least one wall extends upwards.

Preferably, the toggle feet will be provided at a lower portion of the strainer container. Preferably, each of the toggle feet will be provided in a shaped rebate or similar such that when the toggle feet are in the locked condition, each of the toggle feet will not extend outwardly, at least not outwardly in a lateral direction, from the strainer container.

A central portion of the base wall of the strainer container will preferably be raised above one or more outer portions of the base wall. The raised central portion will typically have a corresponding indented portion on the underside of the base wall. This will typically allow liquid to be drained from the container without obstruction by the basewall even when the strainer container is inserted into the container. This configuration will also preferably assist with preventing the establishment of a suction lock between the base wall of the strainer container and the base wall of the container.

Any number of toggle feet can be provided on the strainer container of the present invention depending typically upon the shape and configuration of the strainer container. A preferred form of the strainer container will be substantially rectangular and in this preferred form, typically four toggle feet are provided, but for example in a circular strainer container, three toggle feet may be provided.

Generally, the toggle feet are provided adjacent to the base wall of the strainer container and as mentioned above, it is preferred that each of the toggle feet is provided in a shaped rebate, preferably a shaped rebate provided at the respective corners of the preferred strainer container between the base wall and the sidewall.

The toggle feet are preferably mounted relative to the strainer container via a hinge point or pin allowing the movement of the toggle feet between the locked and released conditions. Typically, any hinge point or pin will typically be oriented substantially parallel to the main longitudinal axis of the strainer container if rectangular. Generally any hinge point or pin will be substantially horizontal.

The toggle feet may have any shape. In a particularly preferred form, each of the toggle feet will be "comma" shaped or have an arcuate lachrymiform shape, having an enlarged mounting portion used to mount each of the toggle feet relative to the strainer container and a preferably tapering engagement portion extending from the enlarged mounting portion. One or more steps may be provided between the enlarged mounting portion and the engagement portion, preferably on an interior side of each of the toggle feet in order to allow the toggle feet to better engage with the upper internal structure and provide an abutment surface against which the upper internal structure can abut in use.

Each of the toggle feet may extend below the lower plane of the strainer container or not. As the strainer container will be capable of being placed on a surface once removed from the container, it is preferred that each of the toggle feet do not extend below the lower plane of the strainer container.

The shape and configuration of each of the toggle feet may be utilised to provide to provide the biasing force mentioned above. For example, each toggle foot may be rubber or similar resilient material and an abutment may be formed between a portion of each toggle foot and a portion of the strainer container when the toggle foot is moved into the locked condition with the abutment requiring at least temporary deformation of a portion of the toggle foot which will in turn create a biasing effect. For example, a resilient flap or similar may be provided on each of the toggle feet in order to abut a portion of the strainer container when the toggle foot is moved into the locked condition. Alternatively, the biasing force mentioned above may be provided through a spring or similar device located relative to each toggle foot.

Each of the toggle feet may be magnetically held to the strainer container in the locked condition and normally, this will be achieved through the provision of one or more magnets or ferromagnetic portions. For example, a magnet (or ferromagnetic portion) may be provided on each toggle foot and a second magnet (or ferromagnetic portion) on a portion of the strainer container adjacent to each toggle foot with the respective magnets attracting each other to hold the toggle foot in the locked condition or alternatively, a magnet may be provided on either the toggle foot or a portion of the strainer container adjacent to the toggle foot, with a ferromagnetic portion provided relative to the other of the toggle foot or portion of the strainer container. Preferably, the magnetic assembly will be provided relative to an inner surface of the toggle foot and an adjacent, lower portion of the strainer container to function by magnetic attraction.

However, a first portion of the magnetic assembly may be provided on or relative to an outer portion of the toggle foot and a corresponding portion of the magnetic assembly may be provided on or relative to the upper internal structure of the container such that the toggle foot is held relative to the strainer container by the force of gravity and under its own weight and is moved outwardly into the engaged condition as the user moves the strainer container upwardly relative to the container at which time the toggle feet are drawn outwardly by the magnetic assembly into the engaged condition and the user can lower the strainer container onto the upper internal structure.

The present invention also includes a container for holding a liquid and having an open top, configured to receive the strainer container, the container having a lower internal structure configured to engage each of the toggle feet when the strainer container is fully inserted into the container to move the toggle feet to the released condition and an upper internal structure configured to engage each of the released toggle feet to hold the strainer container relative to the upper internal structure.

As mentioned above, the shape of the container will generally correspond to the shape of the strainer container. In a preferred form, the container will be generally rectangular having a substantially planar base wall and at least one, and typically four upstanding sidewalls extending from the base wall. Normally the sidewalls will extend upwardly substantially perpendicularly to the base wall but diverging outwardly slightly as they extend upwardly. The at least one sidewall of the container and the base wall will typically be closed in order to allow the container to be watertight and hold a liquid for example.

A particularly preferred embodiment of the present invention is a soaking container in which a user will place items to soak within the strainer container, provide a soaking liquid or mixture into the container and then place the strainer container within the container in order to soak the items within the soaking liquid or mixture and then remove the items from the soaking liquid or mixture using the strainer container without necessarily touching or coming into contact with the soaking liquid or mixture.

The container will typically include one or more lifting handles on one or more sidewalls. Preferably the one or more handles extend laterally from the container and/or sidewall preferably with a portion beneath a lateral extending portion to allow a user to grip the handle with their hand or fingers. Preferably, a handle is provided in each end wall, substantially opposite one another, potentially in a recessed section, preferably centrally across each end wall in order to provide a user with access to the handles of the strainer container without obstruction by the handles of the container when the strainer container is fully inserted into the container.

One or more drain assemblies are preferably provided in the container. Preferably, at least one drain is provided in or adjacent to a bottom wall of the container, which is preferably angled and/or a sump may be provided with a drain opening provided at a low portion of the sump in order to allow the liquid or material to be drained from the container.

In a preferred embodiment, a drain structure is preferably provided in a rectangular portion provided in the base wall with an opening in a substantially vertical wall portion of the rectangular portion and a second opening provided in the base wall of the container. A drain plug is preferably provided on the drain plug is suitably shaped to fit within the rectangular portion in order to close both of the openings in the rectangular portion.

Appropriate sealing mechanisms such as one or more resilient seals will typically be provided in association with the drain and/or drain plug. When the preferred drain plug is inserted into the drain opening, it is preferred that the drain plug will be substantially flush with the outer wall of the container. The gripping portion is typically provided relative to the drain plug in order to allow insertion and removal of the drain plug.

The drain plug may engage with the container in any way for example by friction fit, typically using one or more resilient seals or alternatively, a screw thread for example may be provided.

In relation to the lower internal structure, a single lower internal structure may be provided or a lower internal structure may be provided for each of the toggle feet. The latter is preferred as the container may be more easily cleaned or manufactured in this form without obstruction by a single lower internal structure.

Preferably, each lower internal structure is provided or includes an upstand in order to engage with each of the toggle feet to move in each of the toggle feet to the released condition. Preferably, the upstand extends substantially perpendicularly from the base wall of the container. Preferably the upstand is spaced from an internal side wall surface of the container in order to allow the toggle feet to be received between the upstand and the sidewall of the container.

The upstand or at least a free end of the upstand may be convergent in order to more easily be received between the toggle foot and the adjacent portion of the strainer container. In a particularly preferred form, the upstand may be a finger or a flap extending upwardly, substantially perpendicularly from the base wall of the container. It is preferred that the upstand is rigid in order to force separation of the toggle feet from the adjacent portion of the strainer container when the strainer container is pressed downward into the container.

The lower internal structure is typically positioned to be received between the locked toggle foot and an adjacent portion of the strainer container, to separate them and move the toggle foot to the released condition. Preferably, this occurs when the strainer container is inserted into the container but the release of the toggle feet may require an additional movement such as pressing the strainer container positively into the container rather than simply inserting the strainer container thereinto.

In relation to the upper internal structure, a single upper internal structure may be provided but more than one upper internal structure, one for each toggle foot is preferred. Preferably, the upper internal structure is or includes an abutment shoulder in order to allow engagement of a portion of the toggle foot with the abutment shoulder. Normally, the abutment shoulder will be formed relative to a portion of an adjacent side wall of the container, above the base of the container.

The abutment surface can be integrally formed with the wall and this is preferred. Although any shape can be used, it is preferred that the abutment surface be formed through the provision of a thickened side wall portion. in one simple embodiment, a substantially horizontal land portion may be provided as a part of the thickened side wall portion or alternatively, and more preferred, the thickened side wall portion may extend upwardly into a separated portion spaced from the sidewall in order to receive a portion of the toggle foot between the separated portion and the sidewall. In this configuration, the separator portion will typically extend into the volume of the container from the sidewall.

As mentioned, the abutment surface may be substantially planar or arcuate but preferably, the formation of the preferred separated portion will result in a shaped extension which will typically extend upwardly and inwardly into the volume of the container from the sidewall before merging back into the thickness of the sidewall.

In the further alternative aspect, in which the integrated strainer and container includes a strainer with a plurality of openings in at least one wall thereof and at least one engagement foot, and the container for holding a liquid and having an open top, configured to receive the strainer within, in a soaking position, the container having an upper structure configured to engage at least one engagement foot to hold the strainer relative to the upper structure in a raised, drainage position.

In this configuration, the strainer and the container for holding the liquid will both typically be generally frustopyramidal in shape with a pair of spaced apart end walls that converge downwardly and a pair of spaced apart side walls which converge downwardly, and a base wall.

In the case of the strainer of this alternative aspect, it is preferred that the strainer is generally similar to that explained above but with at least one engagement foot rather than the toggle feet described above.

Preferably, the strainer of this embodiment has side walls which have a stepped profile, that is a lower portion and an upper portion which is separated by a step or land wall to create an upper portion in the strainer which is larger in dimension/area/footprint than the lower portion of the strainer.

In a preferred embodiment, at least one engagement foot is preferably provided on at least one sidewall, typically in association with the step of land wall and preferably, at least one engagement foot is provided on both of the opposed side walls. Typically, the at least one engagement foot is spaced from the base of the strainer and located approximately halfway up the height of the strainer, again, normally associated with the step or land wall. Normally, the step or land wall will be provided on the inside of the strainer with the external configuration being or including at least one engagement foot, provided at approximately the same level.

In a particularly preferred embodiment, each engagement foot is configured as an inverted U-shaped portion or gutter with an opening configured to receive an upper side edge of the container when the strainer is in the elevated drainage position.

At least one engagement foot is provided, and preferably at least one engagement foot on each side wall and even more preferred is the provision of a single elongate engagement foot extending substantially along the length of both sidewalls. In an alternative embodiment, a number of spaced apart engagement feet may be provided on at least one, and typically both of the sidewalls.

As mentioned, the strainer will typically have a base wall at a lower end of the sidewalls and end walls. It is preferred that the base wall of the strainer is provided with at least one engagement portion to also engage with a corresponding portion provided on the container. In this way, the strainer, when in the raised drainage condition will typically be engaged with the upper edge of the container through engagement with the at least one engagement foot but also preferably, the base of the strainer is engaged with a portion of the container to securely locate the strainer in position relative to the container when in the raised drainage condition.

The at least one engagement portion will typically be spaced inwardly from the sidewall of the strainer. Typically, more than one engagement portion will be provided adjacent to, but spaced inwardly from, the side wall on each lateral side of the strainer.

Each engagement portion will typically be elongate and will normally be or include an opening or depression into the base wall from a lower side. In a preferred configuration, three spaced apart engagement portions will be provided on both lateral sides of the base, each being or including an opening, recess or depression. It is particularly preferred that each of the engagement portions be shaped to receive a correspondingly shaped alignment rib or projection provided on an inside portion of the container in order to hold the base of the strainer relative to the sidewall of the container.

As mentioned above, it is preferred that the strainer have a lower side wall and an upper side wall, separated by a step and when the strainer is in the raised, drainage condition, it is preferred that the lower sidewall of the strainer abuts an angled side wall portion, typically an upper angled side wall portion of the container.

The container of the further aspect will typically be configured similarly to the container of the aspects described above and may be configured as a bucket or container in order to contain soak liquid such that items placed into the strainer can then be immersed in the soak liquid by placing the strainer into the container.

It is preferred that the container have a generally frustopyramidal shape with a pair of end walls which converge from an upper portion to a lower portion and a pair of sidewalls which converge from an upper portion to a lower portion and a base wall, together defining a containment volume.

It is preferred that the side walls are each stepped having a lower portion and an upper portion separated by a laterally extending step or land wall. It is particularly preferred that the step or land wall on an inside of the container includes at least one, and typically a number of engagement extensions. It is preferred that a number of engagement extensions are provided and that they are spaced apart, typically equally over the length of the sidewall. In a preferred embodiment, there are three engagement extensions.

The engagement extensions are preferably configured to correspond to the elongate recess or depression engagement portions provided on the base of the strainer. Typically, the engagement extensions extend upwardly from an inside edge of the step or land wall, spaced from the upper portion of the sidewall, at least one surface of the engagement extensions at least generally coplanar with an inside surface of the lower sidewall.

The upper edge of the sidewalls are preferably shaped from engagement with the preferred substantially U-shaped gutter provided on the side wall of the strainer such that the upper edge of the sidewalls can be received within the substantially U-shaped gutter.

An upper portion of the container adjacent to the end walls will typically be enlarged and preferably flared outwardly in order to be used as a handle for the container.

Again, a drain port is typically associated with the base wall of the container, and a sump may be provided with a drain port provided at least partially within the sump.

Preferably, each of the strainer and the container are formed in a single piece of an appropriate material. If plastic, then the strainer and the container can each be moulded.

As with the earlier aspects, once the user decides that they wish to separate the items in the strainer which are in the soak liquid from the soak liquid, the user will typically manually lift the strainer upwardly and laterally using the handle is on the strainer, moving the strainer toward one of the side walls and lowering the strainer such that the upper edge of the container sidewall is received at least partially in the preferred inverted substantially U-shaped gutter and the extensions on the container at least partially located in the recesses on the base of the strainer in order to hold the strainer above the level of the soak liquid in the container but within the container such that soak liquid can then drain from the strainer into the container, all of which can be accomplished without the user actually being required to touch or manipulate the items in the strainer. Once properly located, the strainer can remain in the raised drainage condition for as long as desired. The spent soak liquid can then be emptied from the container using the drain port.

As can be seen, one major advantage of the present invention is that the strainer container can be lifted relative to the container holding the charged soaking liquid and through the engagement of the released toggle feet with the upper internal structure in the container, can be rested in place over the container to allow the charged soaking liquid to drain back into the container, minimising spilling of the charged soaking liquid whilst allowing the user the comfort of not having to touch or come in contact with the charged soaking liquid.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DESCRIPTION OF EMBODIMENTS

According to a particularly preferred embodiment of the present invention, an integrated strainer and container 10 for soaking clothes and the like, is provided.

In the illustrated preferred embodiment, the integrated strainer and container includes a strainer container 11 with a plurality of openings in at least one wall thereof and a number of toggle feet 12 movably mounted to the strainer container 11 between a locked condition in which each of the toggle feet 12 are held to the strainer container 11 and a released condition in which the toggle feet 12 extend from the strainer container 11; and a container 13 for holding a liquid and having an open top, configured to receive the strainer container 11, the container 13 having a lower internal structure configured to engage each of the toggle feet 12 when the strainer container 11 is fully inserted into the container to move the toggle feet 12 to the released condition and an upper internal structure configured to engage each of the released toggle feet 12 to hold the strainer container 11 relative to the upper internal structure.

Figure 2:
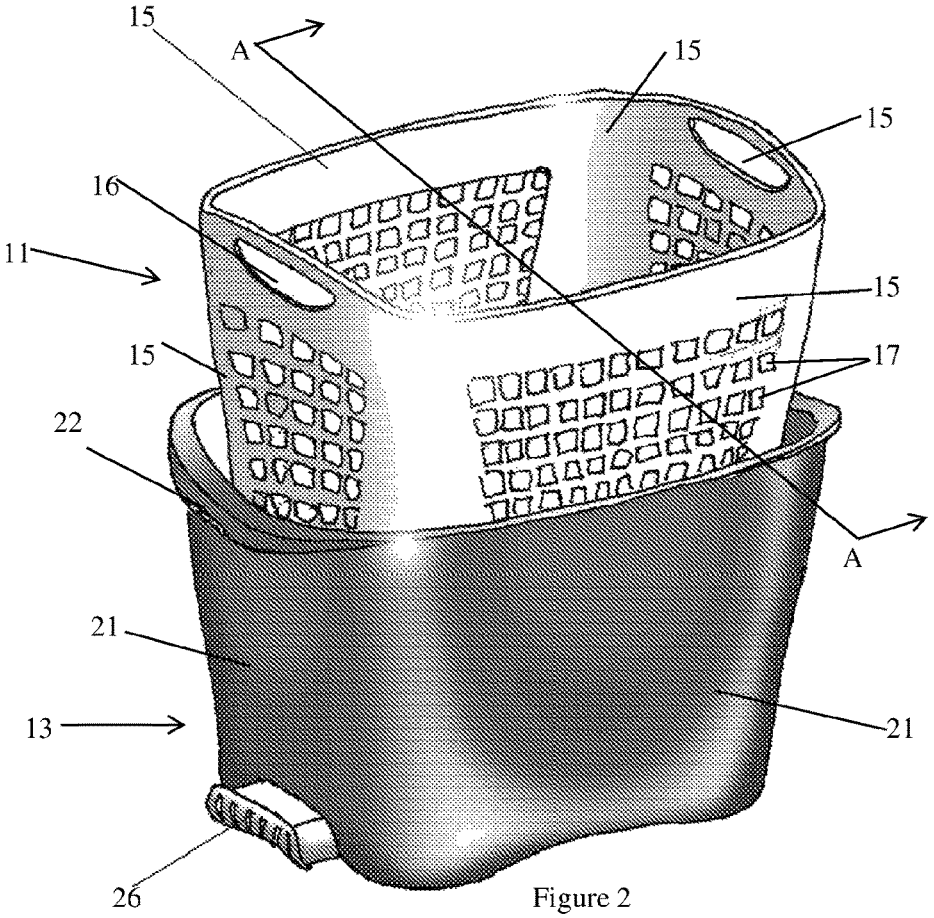
FIG. 2 of the configuration illustrated in FIG. 1 with the strainer in the straining position.
Figure 3:
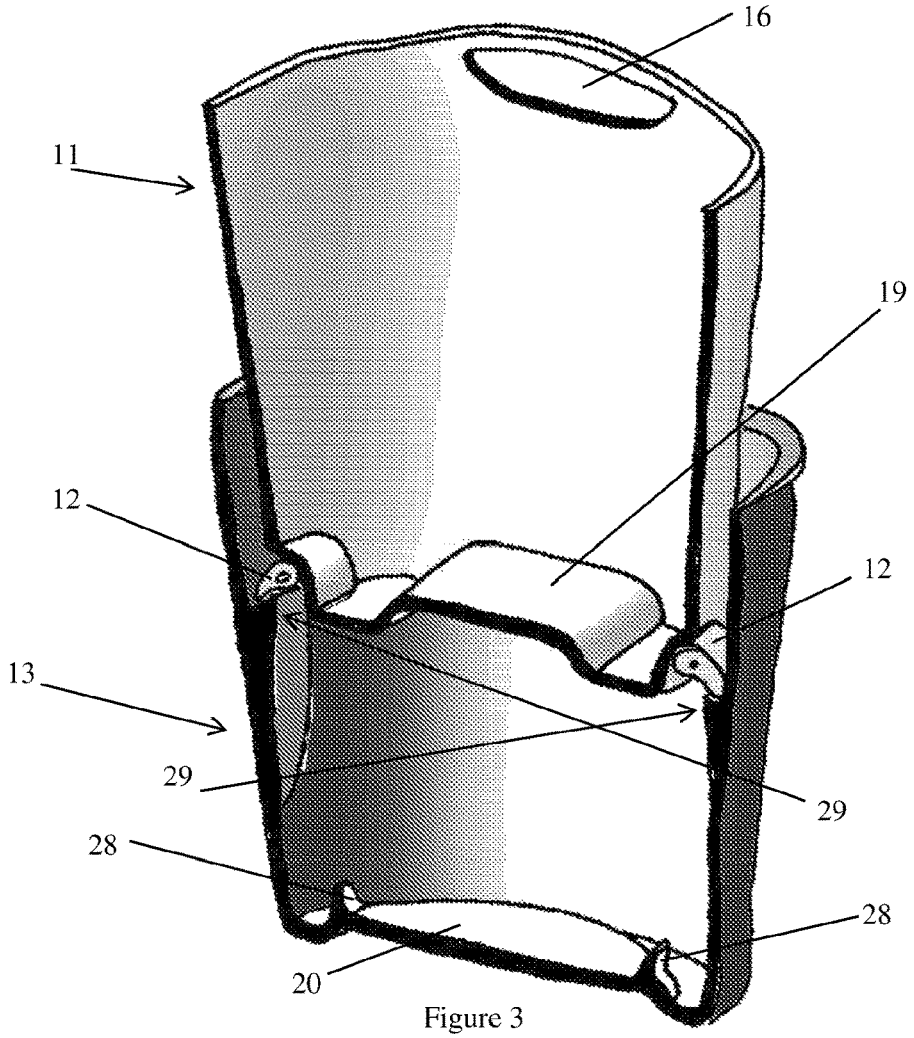
FIG. 3 is an isometric sectional view of the configuration illustrated in FIG. 2 along line A-A.

As can be seen from the accompanying Figures particularly FIGS. 2 and 3, the strainer container 11 can be lifted relative to the container 13 holding the charged soaking liquid and through the engagement of the released toggle feet 12 with the upper internal structure in the container 13, can be rested in place over the container 13 to allow the charged soaking liquid to drain back into the container 13, minimising spilling of the charged soaking liquid whilst allowing the user the comfort of not having to touch or come in contact with the charged soaking liquid.

The strainer container 11 can have any shape but it is preferred that the shape of the strainer container will correspond to that of the container 13 into which it is at least partially received. Any material or combination of materials can be used to form the strainer container 11 but a plastic material is particularly preferred.

The strainer container 11 will preferably be substantially rectangular, having a substantially planar base wall 14 and four sidewalls 15 upstanding, generally perpendicularly, relative to the base wall 14.

Figure 1:
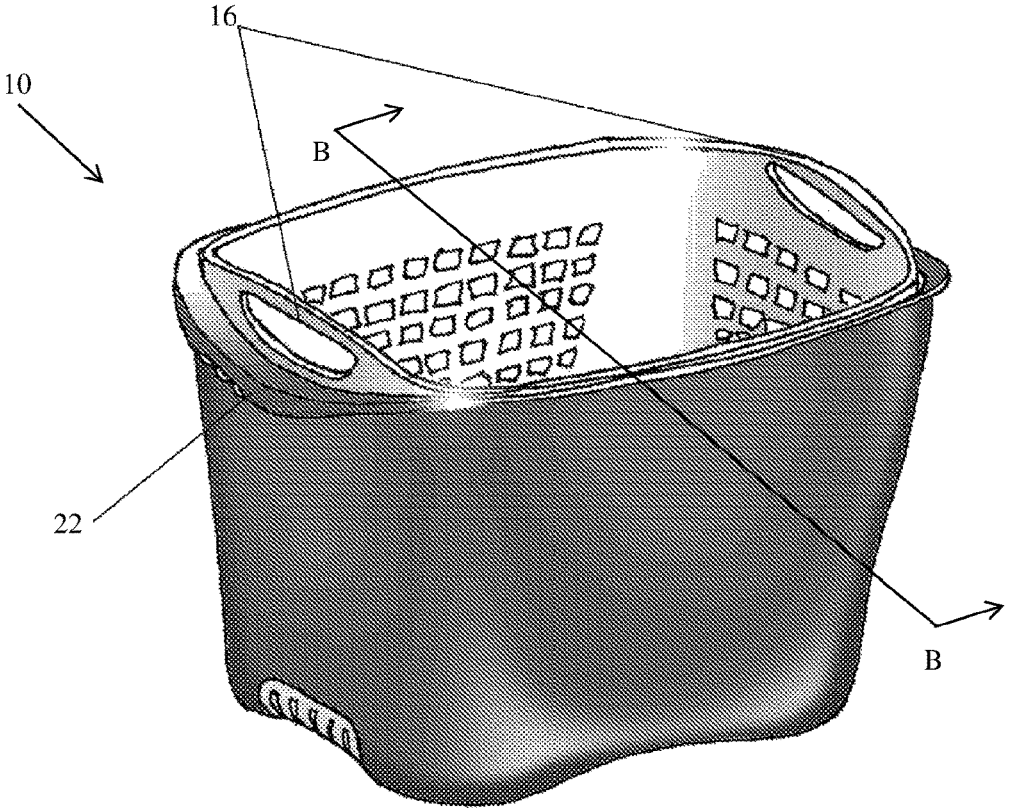
FIG. 1 is an isometric view of a combined strainer and container according to a preferred embodiment of the present invention, with the strainer in the soaking position.

The strainer container 11 will normally be provided with a pair of handles 16 in order to allow a user to grasp of the strainer container 11 to move the strainer container 11 relative to the container 13. The handles 16 will typically be opposed. Each of the handles 16 will preferably be provided as an opening in an upper portion of a sidewall 15 in order to allow to insert their fingers into the openings in order to grasp the strainer container 11. Preferably, when the strainer container 11 is inserted into the container 13, the handles 15 will be positioned above an upper terminus of the walls of the container 13 to allow a user to access the handles 15 of the strainer container 11 even when the strainer container 11 is fully inserted into the container 13, as shown in FIG. 1.

The strainer container 11 will normally be provided with a number of openings 17 in the wall portions in order to allow items placed into the strainer container 11 to be retained in the strainer container 11 but to allow liquid to escape from strainer container 11 when required. AS illustrated, groups of openings 17 are provided with solid wall and corner portions in between for strength. For example, in a particularly preferred embodiment where the strainer container 11 is substantially rectangular, each of the sidewalls 15 have a regular array of openings 17 therein with arcuate corner portions (between the respective sidewalls 15) which are solid and provide strength to the strainer container 11.

Figure 4:
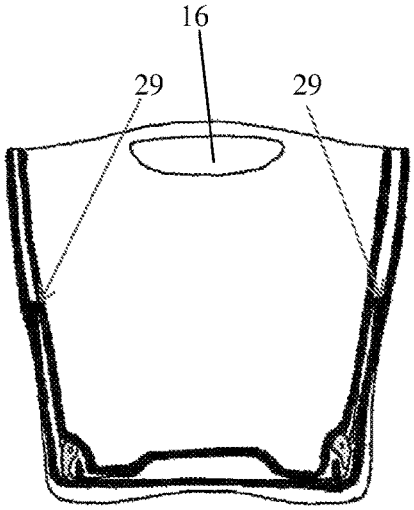
FIG. 4 is a sectional view of the configuration illustrated in FIG. 1 along line B-B.
Figure 5:
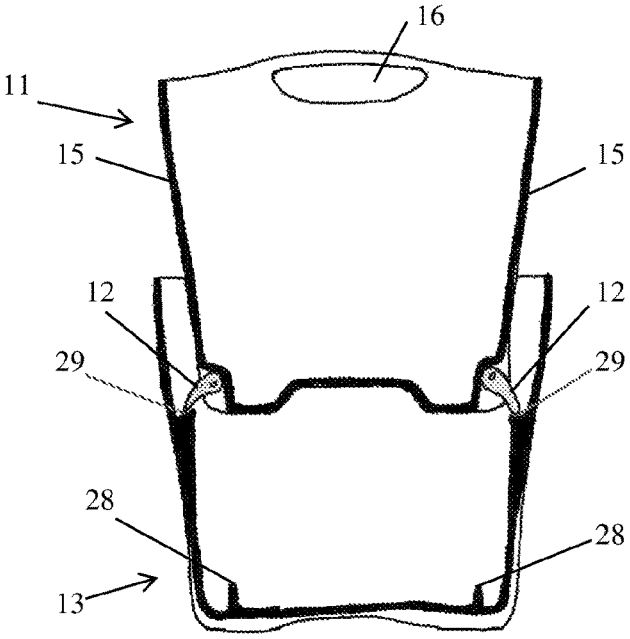
FIG. 5 is a sectional end view of the configuration illustrated in FIG. 2 along line B-B.
Figure 6:
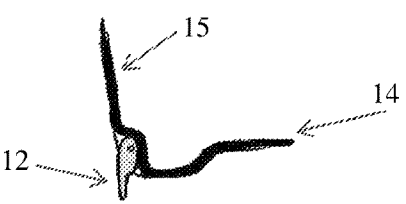
FIG. 6 is a detailed view of the portion illustrated in FIG. 4 with the toggle foot in the locked condition.
Figure 7:
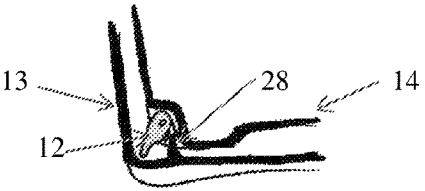
FIG. 7 is a detailed view of the portion illustrated in FIG. 4 showing the movement of the toggle foot from the locked condition to the released condition by the lower internal release structure.
Figure 8:
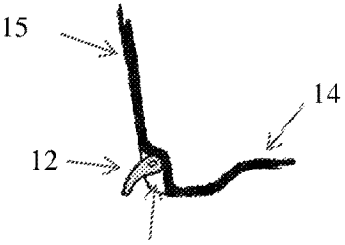
FIG. 8 is a detailed view of the portion illustrated in FIG. 4 showing the toggle foot in the released condition.

As shown in FIGS. 4 and 5, the side walls of the strainer container 11 diverge outwardly from the base wall 14 as the side walls extend upwards.

In the preferred embodiment, the toggle feet 12 are provided at a lower portion of the strainer container 11. Each of the toggle feet 12 are provided in a shaped rebate 18 such that when the toggle feet 12 are in the locked condition, each of the toggle feet 12 do not extend outwardly from the strainer container 11.

A central portion 19 of the base wall 14 of the strainer container 11 is raised above one or more outer portions 20 of the base wall 14. The raised central portion 19 has a corresponding indented portion on the underside of the base wall 14. This will typically allow liquid to be drained from the container 13 without obstruction even when the strainer container 11 is inserted into the container. This configuration will also preferably assist with preventing the establishment of a suction lock between the base wall 14 of the strainer container 11 and the base wall of the container 13.

Any number of toggle feet 12 can be provided on the strainer container 11 of the present invention depending typically upon the shape and configuration of the strainer container 11. A preferred form of the strainer container 11 is substantially rectangular and in this preferred form, typically four toggle feet 12 are provided.

Generally, the toggle feet 12 are provided adjacent to the base wall 14 of the strainer container 11 and as mentioned above, it is preferred that each of the toggle feet 12 is provided in a shaped rebate 18, preferably provided at the corners of the strainer container 11 between the base wall 14 and the sidewall 15.

The toggle feet 12 are preferably mounted relative to the strainer container 11 via a hinge point or pin allowing the movement of the toggle feet 12 between the locked and released conditions. Typically, any hinge point or pin will typically be oriented substantially parallel to the main longitudinal axis of the strainer container if rectangular, and generally any hinge point or pin will be substantially horizontal.

The toggle feet 12 may have any shape. In a particularly preferred form, each of the toggle feet 12 are "comma" shaped or have an arcuate lachrymiform shape, having an enlarged mounting portion used to mount each of the toggle feet 12 relative to the strainer container 11 and a tapering engagement portion extending from the enlarged mounting portion. One or more steps may be provided between the enlarged mounting portion and the engagement portion, preferably on an interior side of each of the toggle feet 12 in order to allow the toggle feet 12 to better engage with the upper internal structure and provide an abutment surface against which the upper internal structure can abut in use.

Each of the toggle feet 12 may extend below the lower plane of the strainer container 11 or not.

In the illustrated preferred embodiment, each of the toggle feet 12 are magnetically held to the strainer container 11 in the locked condition and normally, this will be achieved through the provision of one or more magnets or ferromagnetic portions. For example, a magnet may be provided on each toggle foot 12 and on a portion of the strainer container 11 adjacent to each toggle foot 12 with the respective magnets attracting each other to hold the toggle foot 12 in the locked condition or alternatively, a magnet may be provided on either the toggle foot 12 or a portion of the strainer container 11 adjacent to the toggle foot 12 with a ferromagnetic portion provided relative to the other of the toggle foot 12 or portion of the strainer container 11. Preferably, the magnetic assembly will be provided relative to an inner surface of the toggle foot and an adjacent, lower portion of the strainer container 11 to function by magnetic attraction.

The present invention also includes a container 13 for holding a liquid and having an open top, configured to receive the strainer container 11, the container 13 having a lower internal structure configured to engage each of the toggle feet 12 when the strainer container 11 is fully inserted into the container 13 to move the toggle feet 12 to the released condition and an upper internal structure configured to engage each of the released toggle feet 12 to hold the strainer container 11 relative to the upper internal structure.

As mentioned above, the shape of the container 13 will generally correspond to the shape of the strainer container 11. In a preferred form, the container will be generally rectangular having a substantially planar base wall 20 and typically four upstanding sidewalls 21 extending from the base wall 20. Normally the sidewalls 21 will extend upwardly substantially perpendicularly to the base wall 20 but diverging outwardly slightly as they extend upwardly. The sidewalls 21 of the container 13 and the base wall 20 will typically be closed in order to allow the container to be watertight and hold a liquid for example.

A particularly preferred embodiment of the present invention is a soaking container in which a user will place items to soak within the strainer container, provide a soaking liquid or mixture into the container and then place the strainer container within the container in order to soak the items within the soaking liquid or mixture and then remove the items from the soaking liquid or mixture using the strainer container without necessarily touching or coming into contact with the soaking liquid or mixture.

The container 13 will typically include a pair of lifting handles 22 on the endwalls. As illustrated, the handles 22 extend laterally from the container 13 with a portion beneath a lateral extending portion to allow a user to grip the handle 22 with their hand or fingers. A handle 22 is provided in each end wall, substantially opposite one another in a recessed section, preferably centrally across each end wall in order to provide a user with access to the handles 16 of the strainer container 11 without obstruction by the handles 22 of the container 13 when the strainer container 11 is fully inserted into the container 13.

Figure 9:
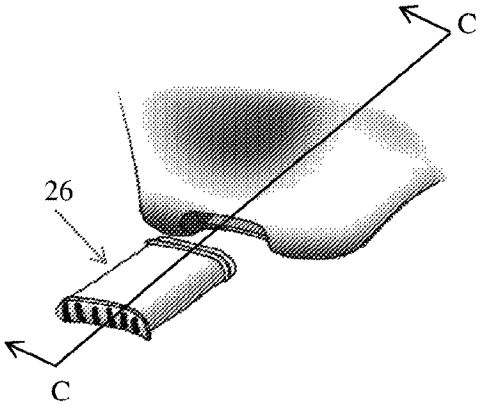
FIG. 9 is a detailed view of the drain assembly according to a preferred embodiment of the present invention.
Figure 10:
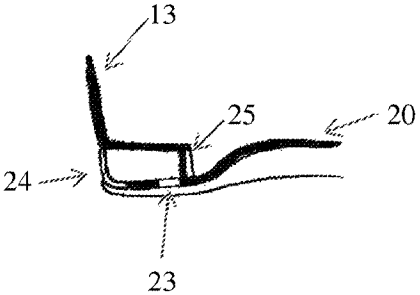
FIG. 10 is a sectional side view of the configuration illustrated in FIG. 9 along line C-C with the drain plug in the sealing condition.
Figure 11:
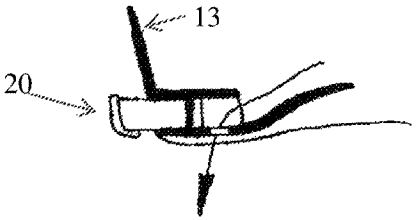
FIG. 11 is a sectional side view of the configuration illustrated in FIG. 9 along line C-C with the drain plug in the drain condition.

As illustrated in FIGS. 9 to 11 in particular, a drain is provided in or adjacent to a bottom wall of the container 13, is a sump 24 with a drain opening 23 provided at a low portion of the sump 24 in order to allow the liquid or material to be drained from the container 13.

In a preferred embodiment, the drain opening 23 is preferably provided in a rectangular portion provided in the base wall 20 with a second opening 25 in a substantially vertical wall portion of the rectangular portion to allow liquid to flow as illustrated in FIG. 11. A drain plug 26 is preferably provided on the drain plug is suitably shaped to fit within the rectangular portion in order to close both of the openings 23, 25 in the rectangular portion.

Appropriate sealing mechanisms such as one or more resilient seals 27 are provided in association with the drain plug 26. When the drain plug 26 is inserted into the sump 24, the drain plug 26 is substantially flush with the outer wall of the container 13 as shown in FIG. 1. A gripping portion is typically provided relative to the drain plug 26 in order to allow insertion and removal of the drain plug 26.

The drain plug 26 may engage with the container in any way for example by friction fit, typically using one or more resilient seals 27.

In relation to the lower internal structure, a single lower internal structure may be provided or a lower internal structure may be provided for each of the toggle feet. The latter is preferred as the container may be more easily cleaned or manufactured in this form without obstruction by a single lower internal structure.

Preferably, each lower internal structure is r includes an upstand 28 in order to engage with each of the toggle feet 12 to move in each of the toggle feet 12 to the released condition. Preferably, the upstand 28 extends substantially perpendicularly from the base wall 20 of the container 13. Preferably the upstand 28 is spaced from an internal side wall surface of the container 13 in order to allow the toggle feet 12 to be received between the upstand 28 and the sidewall of the container 13.

The upstand 28 or at least a free end of the upstand 28 may be convergent in order to more easily be received between the toggle foot 13 and the adjacent portion of the strainer container 11. In a particularly preferred form, the upstand 28 may be a finger or a flap extending upwardly, substantially perpendicularly from the base wall of the container 13. It is preferred that the upstand 28 is rigid in order to force separation of the toggle feet 12 from the adjacent portion of the strainer container 11 when the strainer container 11 is pressed downwardly into the container 13.

The upstand 28 is typically positioned to be received between the locked toggle foot 12 and an adjacent portion of the strainer container 11 to separate them and move the toggle foot 12 to the released condition. Preferably, this occurs when the strainer container 11 is inserted into the container 13 but the release of the toggle feet 12 may require an additional movement such as pressing the strainer container 11 positively into the container 13 rather than simply inserting the strainer container 11 thereinto.

In relation to the upper internal structure 29, a single upper internal structure may be provided but more than one upper internal structure, one for each toggle foot 12 is preferred. IN the preferred form illustrated, the upper internal structure is or includes an arcuate abutment shoulder in order to allow engagement of a portion of the toggle foot 12 with the abutment shoulder as illustrated in FIGS. 3 and 5. Normally, the abutment shoulder will be formed relative to a portion of an adjacent side wall of the container 13, above the base of the container.

The abutment surface can be integrally formed with the wall and this is preferred. Although any shape can be used, it is preferred that the abutment surface be formed through the provision of a thickened side wall portion as illustrated. In one simple embodiment, a substantially horizontal land portion may be provided as a part of the thickened side wall portion or alternatively, and more preferred, the thickened side wall portion may extend upwardly into a separated portion spaced from the sidewall in order to receive a portion of the toggle foot 12 between the separated portion and the sidewall. In this configuration, the separated portion will typically extend into the volume of the container from the sidewall.

Figure 12:
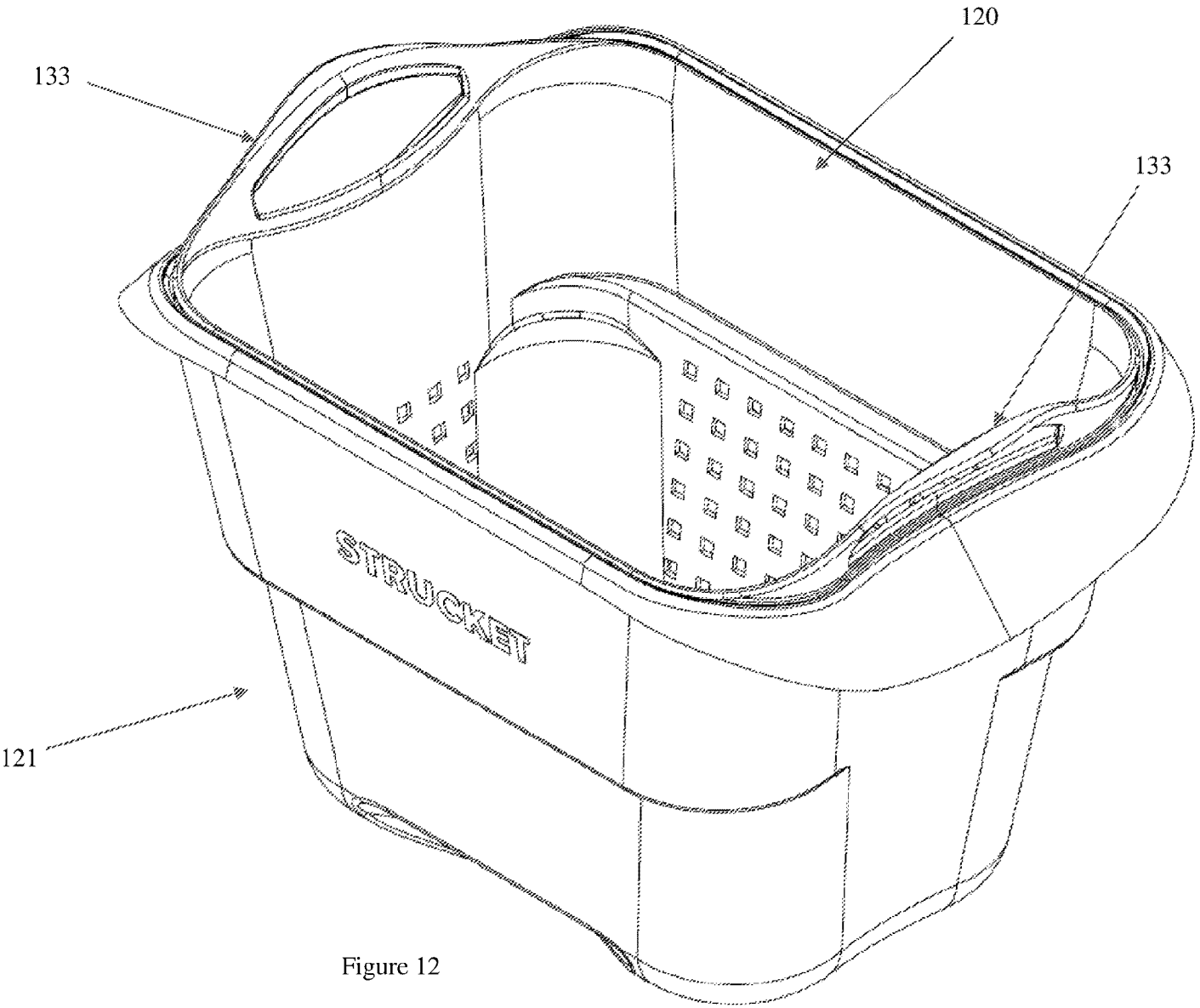
FIG. 12 is an isometric view of a combined strainer and container according to a further preferred embodiment of the present invention, with the strainer in the soaking position
Figure 13:
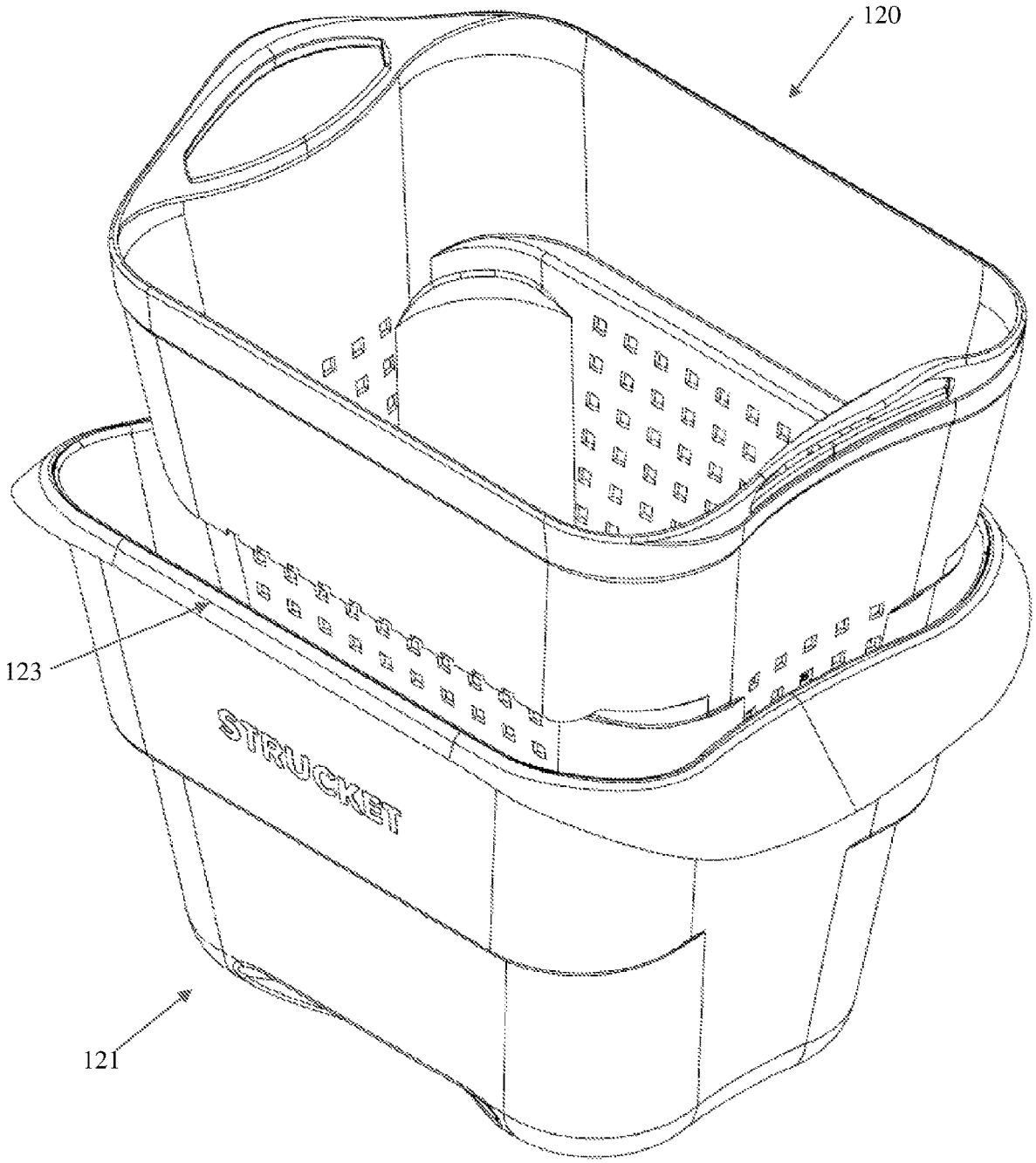
FIG. 13 is an isometric view of the combined strainer and container as illustrated in FIG. 12 with the strainer in the raised, drainage position.
Figure 14:
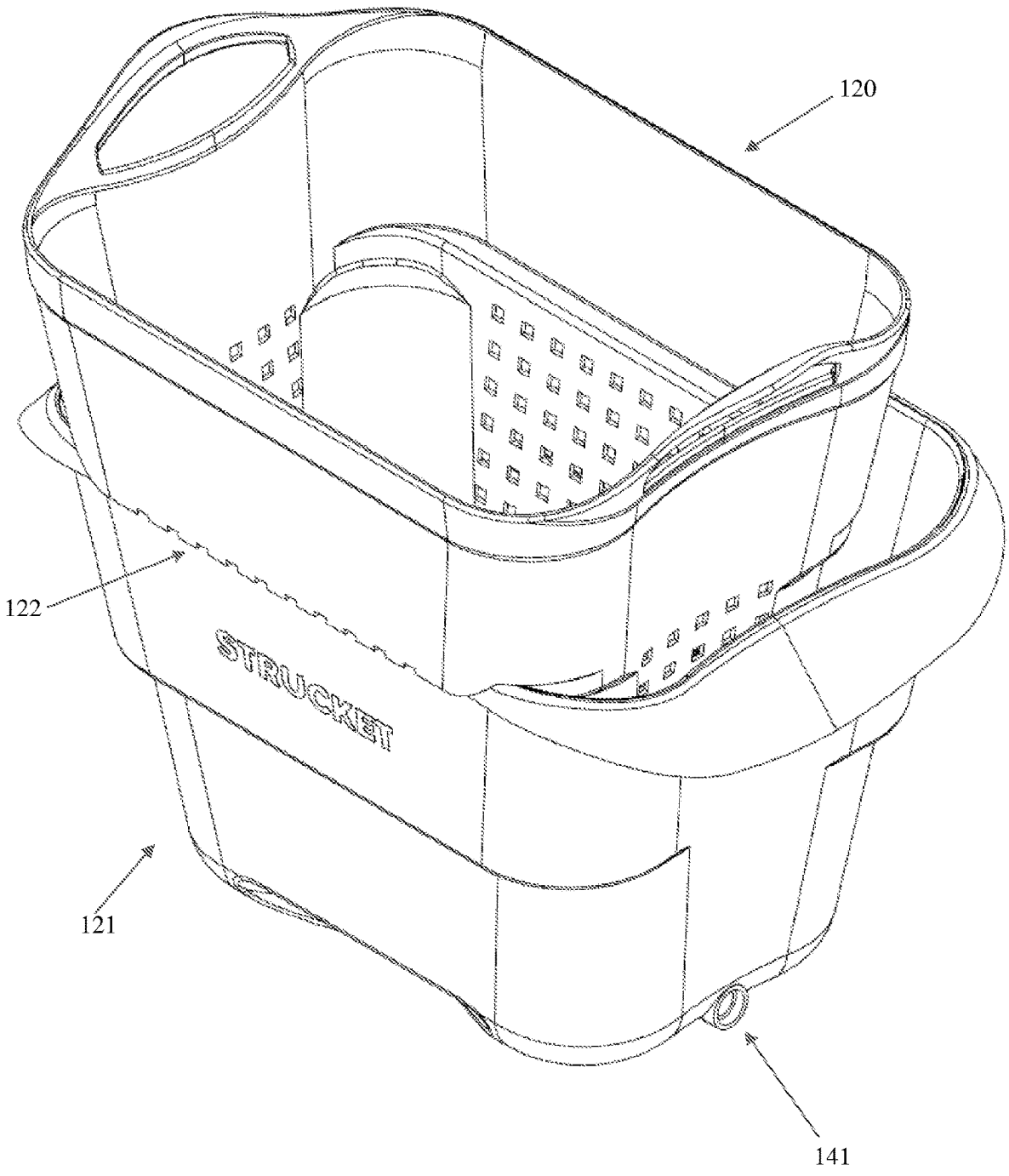
FIG. 14 is an isometric view of the configuration illustrated in FIG. 13 from the opposite side.
Figure 15:
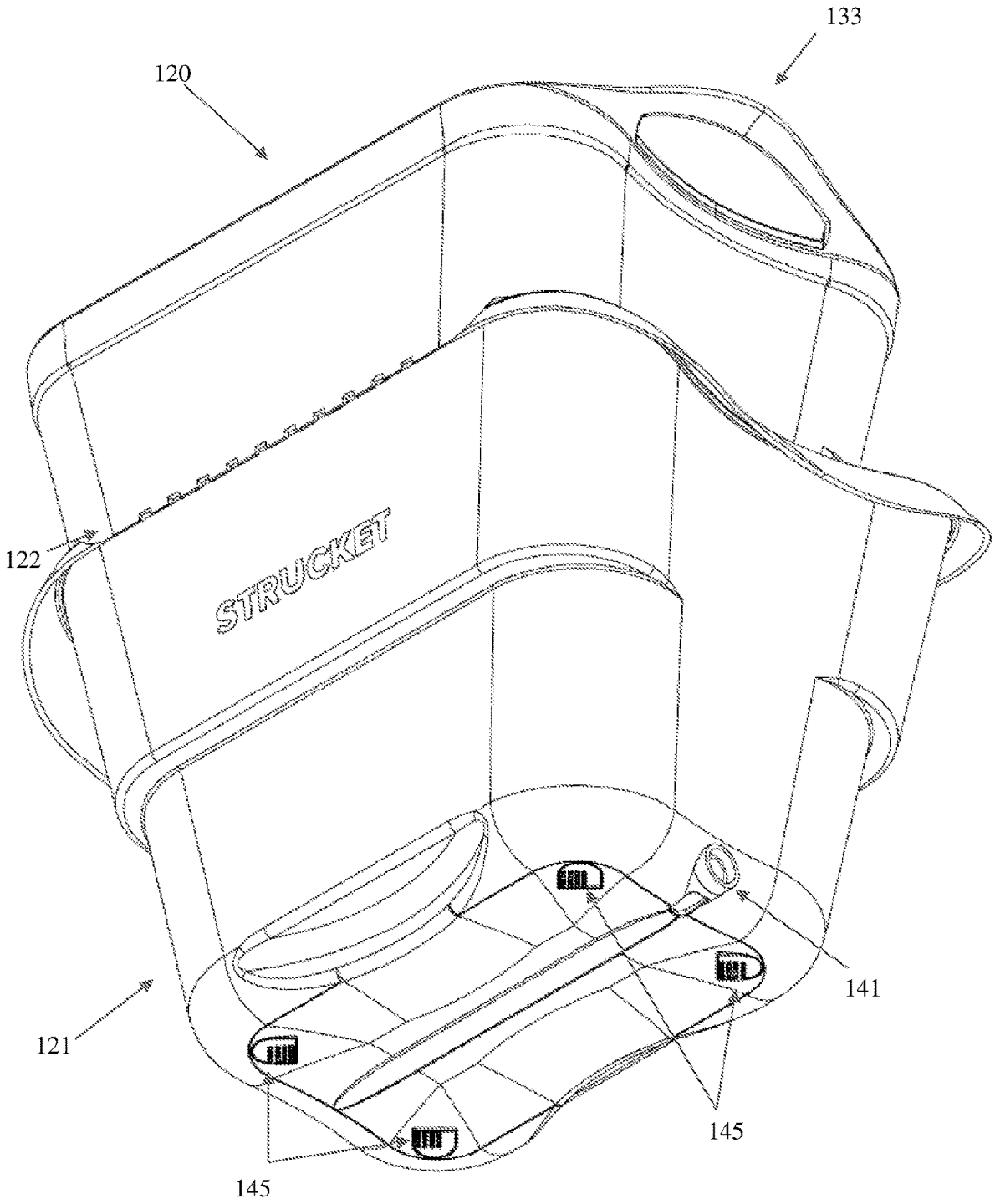
FIG. 15 is an isometric view of the configuration illustrated in FIG. 13 from the bottom.
Figure 17:
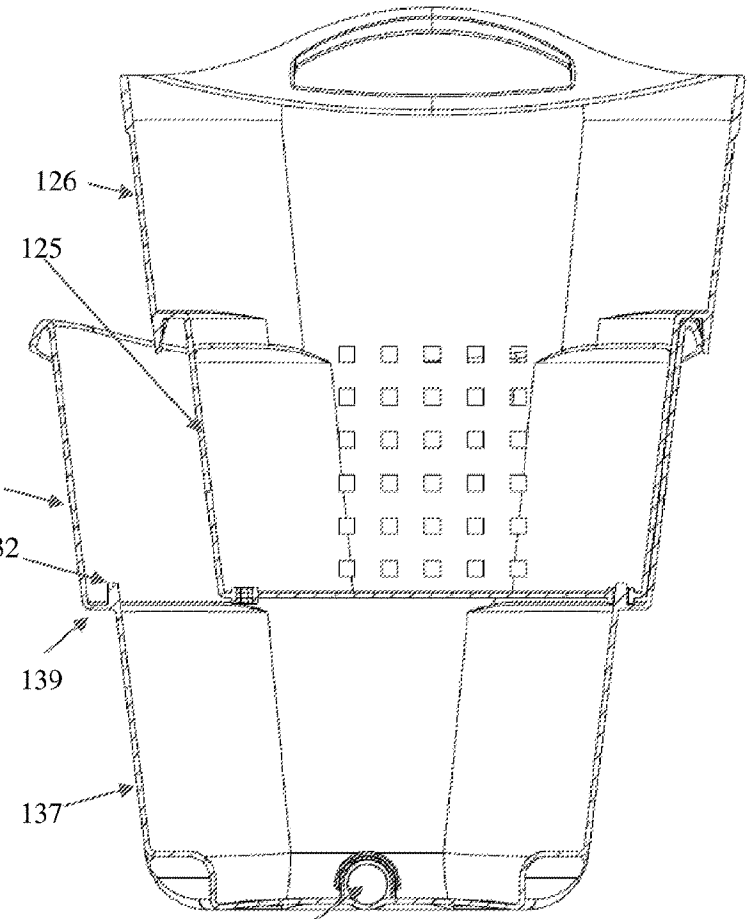
FIG. 17 is a sectional end view of the configuration illustrated in FIG. 16 along line D-D.
Figure 16:
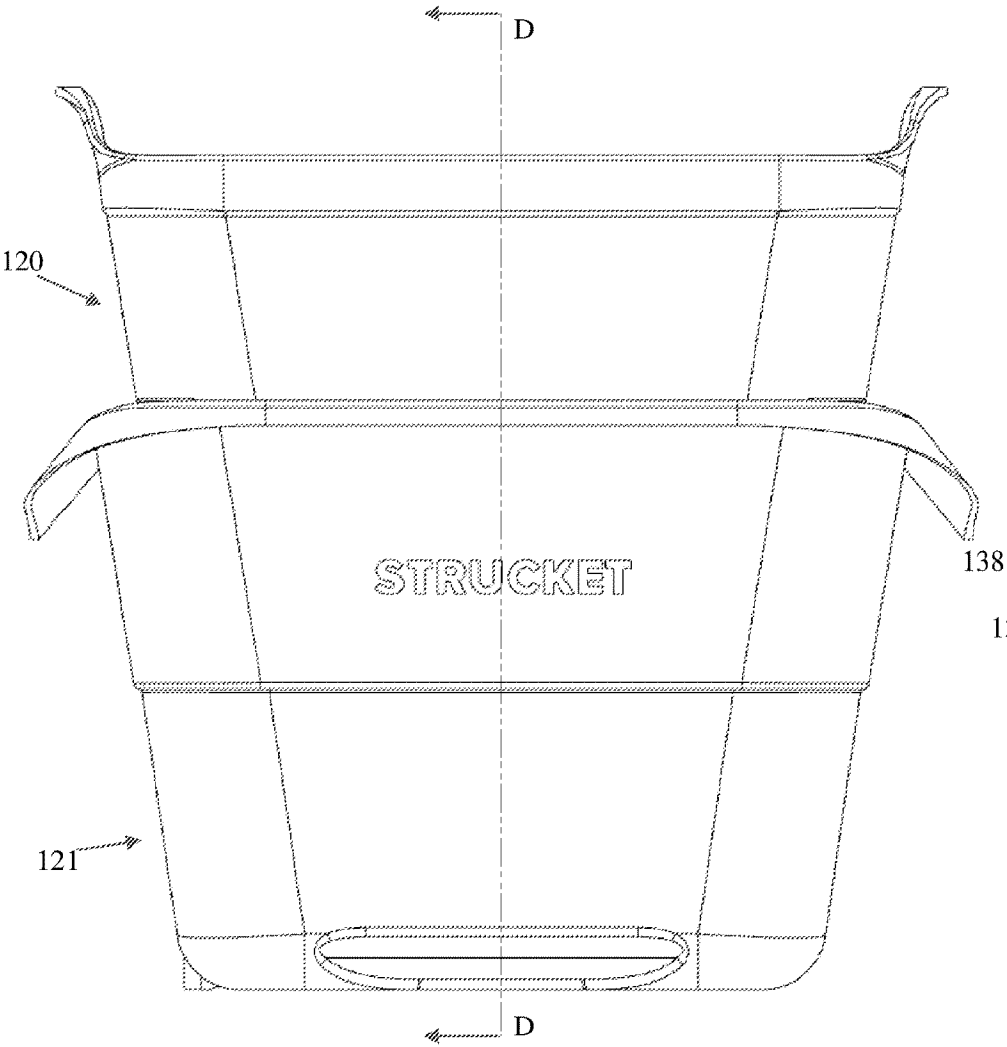
FIG. 16 is a side view of the configuration illustrated in FIG. 13.
Figure 18:
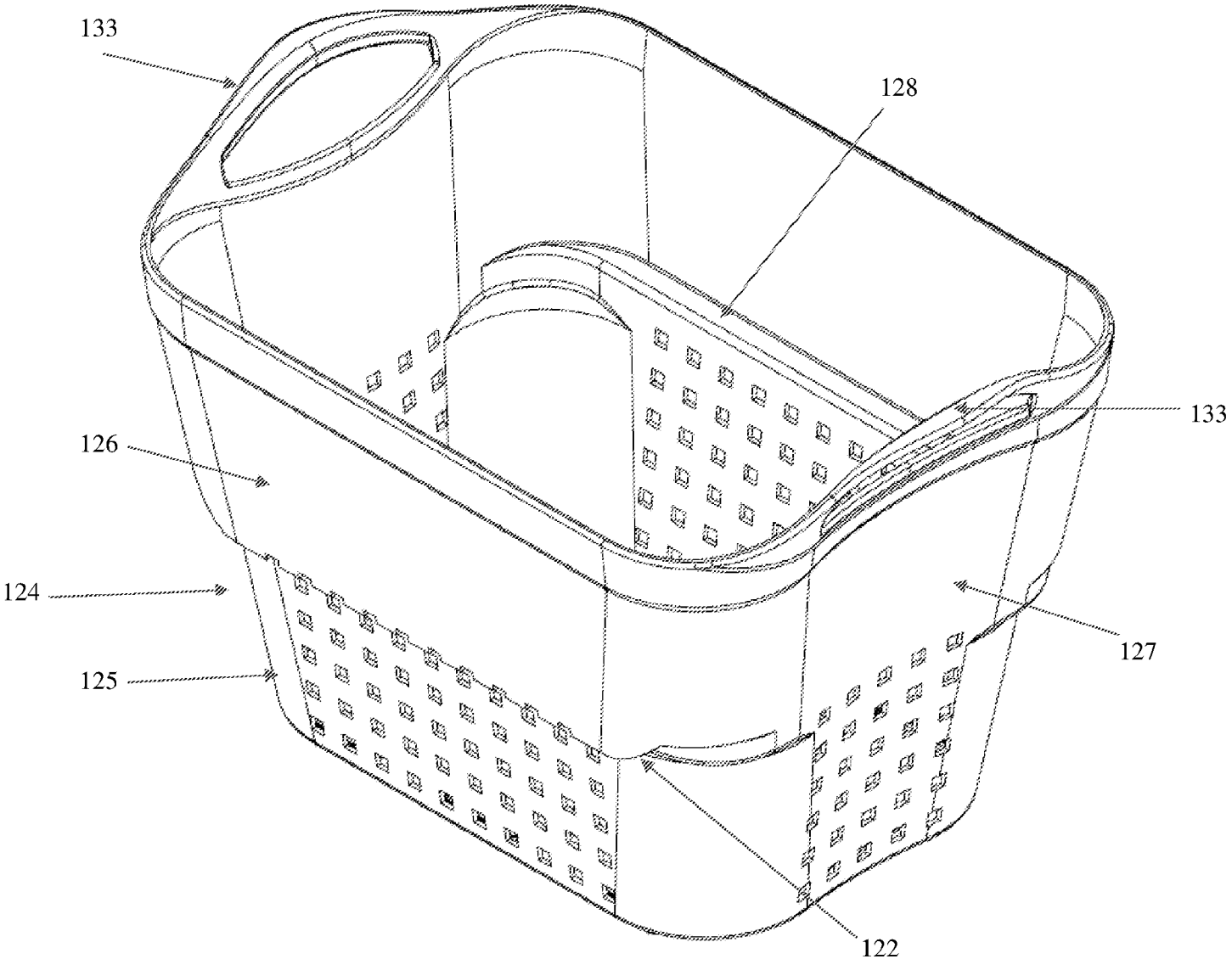
FIG. 18 is an isometric view of the strainer of the configuration illustrated in FIG. 13.

In the further alternative aspect illustrated in FIGS. 12 to 23, the integrated strainer and container includes a strainer 120 with a plurality of openings (shown as square openings, unnumbered) in the walls thereof as shown in FIG. 18 in particular and an engagement foot 122 on each lateral side thereof and a container 121 for holding a liquid and having an open top, configured to receive the strainer 120 within, in a soaking position as illustrated in FIG. 12. The container 121 has an upper sidewall edge 123 structure configured to engage the engagement foot 122 to hold the strainer 120 relative to the upper sidewall edge 123 when in a raised, drainage position as shown in FIGS. 13 and 14.

As illustrated, the strainer and the container for holding the liquid will both typically be generally frustopyramidal in shape with a pair of spaced apart end walls that converge downwardly and a pair of spaced apart side walls which converge downwardly and a base wall.

Figure 20:
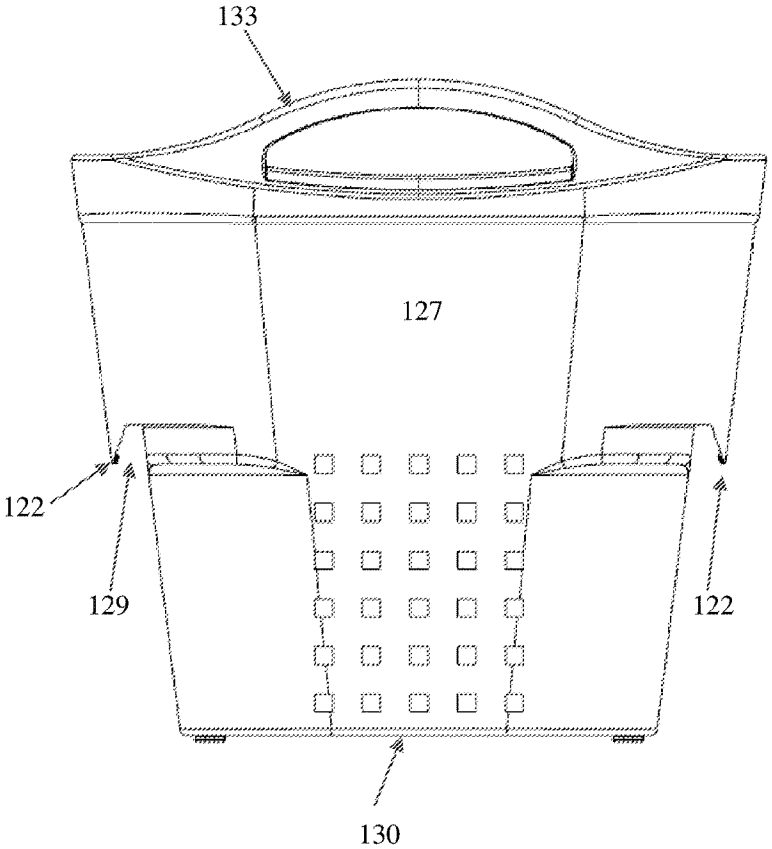
FIG. 20 is an end view of the strainer illustrated in FIG. 18.
Figure 19:
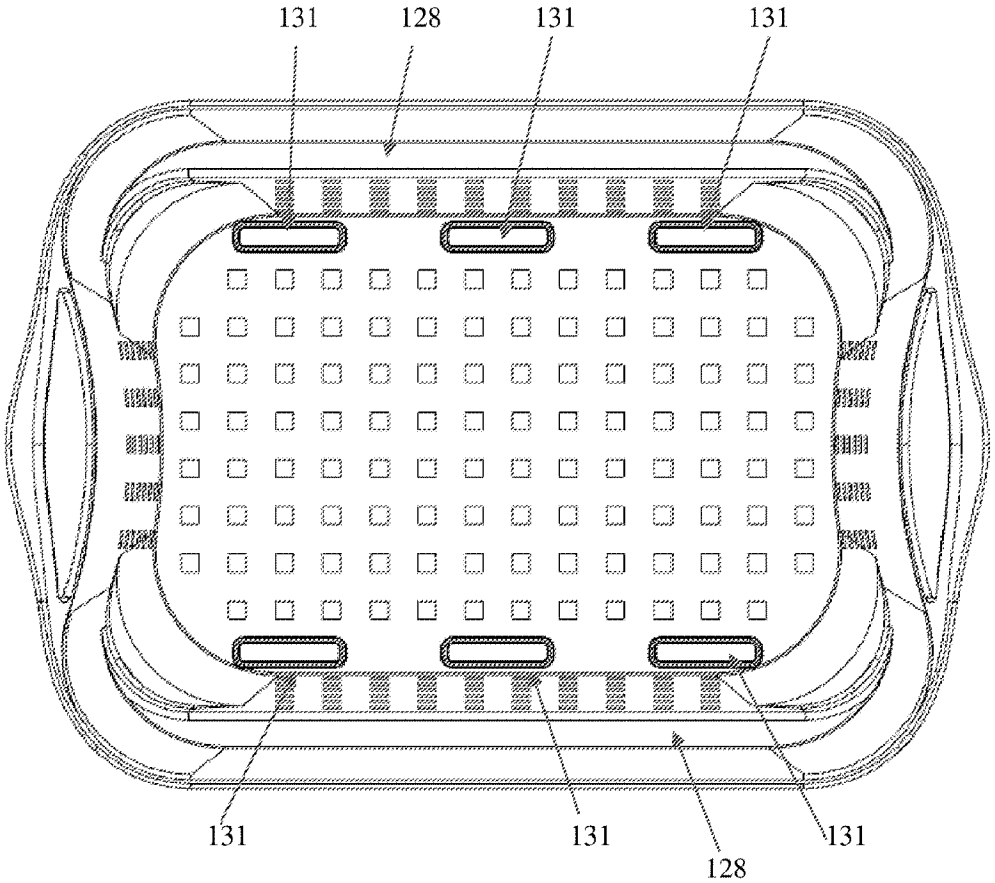
FIG. 19 is view from above of the strainer illustrated in FIG. 18.

In the case of the strainer 120 of this alternative aspect, best illustrated separated from the container 121 in FIGS. 18 to 20, the strainer 120 is generally frustopyramidal in shape with a pair of spaced apart side walls 124, each of which has a stepped profile, that is a lower sidewall portion 125 and an upper sidewall portion 126 which is separated by a step 128 to create an upper portion which is larger in dimension than the lower portion of the strainer 120. Normally, the step 128 is provided on the inside of the strainer 120 with the external configuration being or including the engagement foot 122.

In a preferred embodiment, an engagement foot 22 is provided on each sidewall, 124 typically in association with the step 128. Typically, the engagement foot 122 is spaced from the base of the strainer 120 and located approximately halfway up the height of the strainer 120, again, normally associated with the step 128 but on an outer side of the strainer 120.

In a particularly preferred embodiment illustrated best in FIGS. 17 and 20, each engagement foot 122 is configured as an inverted U-shaped gutter defining an opening 129 configured to receive an upper side edge 123 of the container 121 when the strainer 120 is in the elevated drainage position as illustrated in FIG. 17 in particular.

An engagement foot 122 is provided on both side walls 124 and as a single elongate engagement foot 122 extending substantially along the length of the sidewall 124.

The strainer 120 has a base wall at a lower end of the sidewalls 124 and end walls 127. As shown in FIG. 19, the base wall 130 of the strainer 120 is provided with a number of engagement recesses 131 to engage with a corresponding portion provided on the container 121. In this way, the strainer 120, when in the raised drainage condition is engaged with the upper edge 123 of the sidewall of the container 121 through engagement with the engagement foot 122 but the base wall 130 of the strainer 120 is also engaged with a portion of the container 121 via the engagement recesses 131 to securely locate the strainer 121 in position relative to the container 121 when in the raised drainage condition as shown in FIG. 17.

The engagement recesses 131 are spaced inwardly from the lower sidewall 15 of the strainer 120. As shown, three engagement recesses 131 are provided adjacent to, but spaced inwardly from each side wall on both lateral sides of the strainer 120.

Each engagement recess 131 is elongate and include depression into the base wall 130 from the underside side. Each of the engagement recesses 131 are shaped to receive a correspondingly shaped alignment rib or projection 132 provided on an inside portion of the container 121 in order to hold the base of the strainer 120 relative to the sidewall of the container 121.

As mentioned above, the strainer 120 has a lower side wall 125 and an upper side wall 126, separated by the step 128 and when the strainer 120 is in the raised, drainage condition, as shown in FIG. 17. the lower sidewall 125 of the strainer 120 abuts an upper angled side wall portion of the container 121 which together with the engagement between the engagement foot 122 and the aligned engagement recesses and ribs, holds the strainer 120 in a stable position relative to the container 121.

Figure 21:
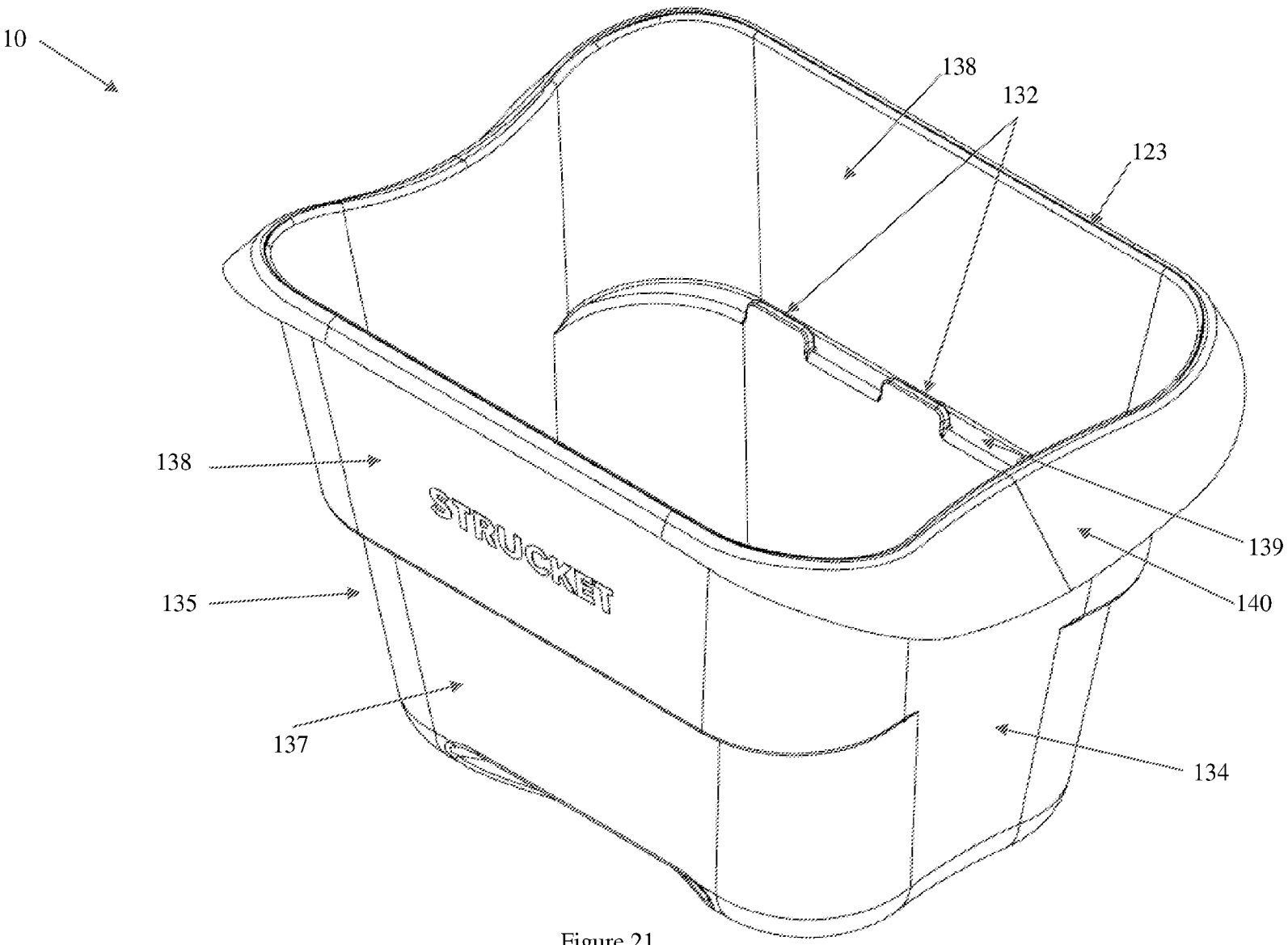
FIG. 21 is an isometric view of the container of the configuration illustrated in FIG. 13.
Figure 23:
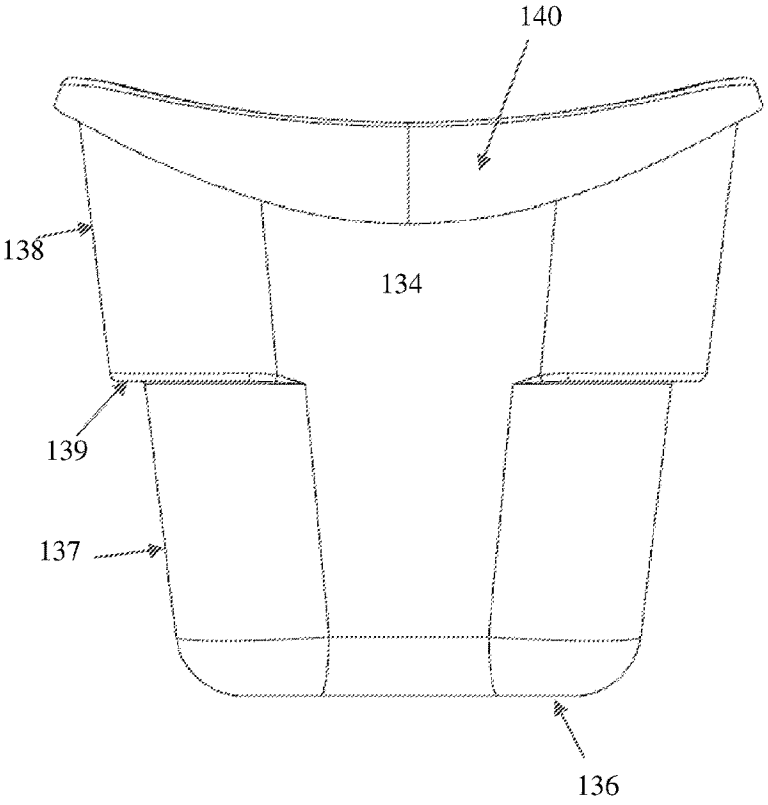
FIG. 23 is an end view of the strainer illustrated in FIG. 21.
Figure 22:
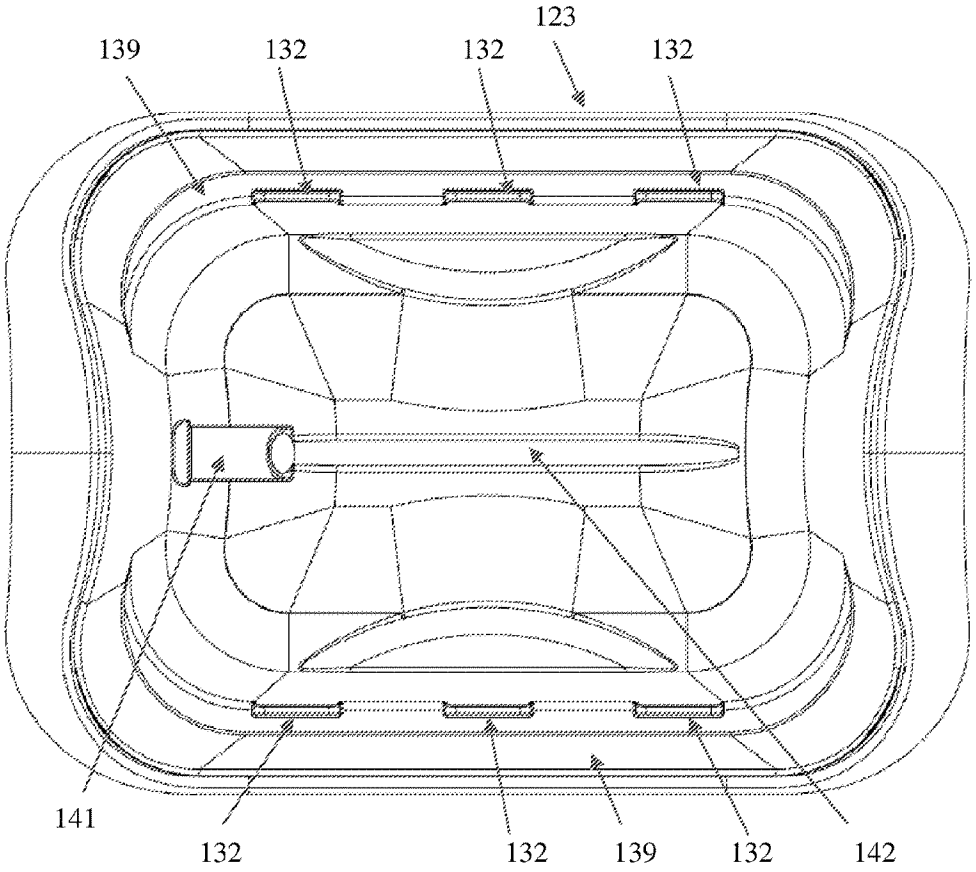
FIG. 22 is view from above of the strainer illustrated in FIG. 21.

The container 121 of this embodiment, as best illustrated separately from the strainer in FIGS. 21 to 23, is configured as a bucket container with an open top in order to contain soak liquid such that items placed into the strainer 120 can then be immersed in the soak liquid in the container 121 by placing the strainer into the container 121.

The container 121 of the illustrated embodiment has a generally frustopyramidal shape with a pair of end walls 134 which converge from an upper portion to a lower portion and a pair of sidewalls 135 which converge from an upper portion to a lower portion and a base wall 136, together defining a containment volume into which the strainer 120 can be placed for soaking items within the strainer 120.

As shown, the side walls 135 are each stepped having a lower portion 137 and an upper portion 138 separated by a laterally extending step 139. As shown in FIG. 21 in particular, the step 139 on an inside of the container 121 includes a number of engagement ribs 132. The engagement ribs 132 are spaced apart equally over the length of the sidewall 135 and spaced from the sidewall, extending substantially parallel to the sidewall.

The engagement ribs 132 are configured to correspond to the elongate engagement recesses 131 provided on the base of the strainer 120. As shown, the engagement ribs 132 extend upwardly from an inside edge of the step 139, spaced inwardly from the upper portion 138 of the sidewall 135, and an inner surface of the engagement ribs 132 is at least generally coplanar with an inside surface of the lower sidewall 137.

The upper edge 123 of the sidewalls 135 is shaped for engagement with the substantially U-shaped opening 129 of the engagement foot 122 provided on the side wall 124 of the strainer 120 such that the upper edge 123 of one of the sidewalls 135 can be received within the substantially U-shaped opening as shown in FIG. 129 as shown in FIG. 17.

An upper portion 140 of the container 121 adjacent to the end walls 134 is enlarged and flared outwardly in order to be used as a handle for the container 121.

Again, a drain port 141 is associated with the base wall 136 of the container 121, and a sump 142 is provided with the drain port 141 provided at least partially within the sump 142.

Preferably, each of the strainer 120 and the container 121 are formed in a single piece of an appropriate material. If plastic, then the strainer 120 and the container 121 can be moulded. The container illustrated includes four rubber (or similar material) feet 145 on the underside of the base wall to reduce slippage of the container.

As with the earlier aspects, once the user decides that they wish to separate the items in the strainer 120 which are in the soak liquid, from the soak liquid, the user will typically manually lift the strainer 120 upwardly and laterally using the handles 133 on the strainer 120, moving the strainer 120 toward one of the side walls 135 of the container 121 and lowering the strainer 120 such that the upper edge 123 of the container sidewall 135 is received at least partially in the inverted substantially U-shaped opening 129 and the engagement ribs 132 on the container 121 are at least partially located in the engagement recesses 131 on the base wall 130 of the strainer 120 in order to hold the strainer 120 above the level of the soak liquid in the container 121 but within or over the container 121 such that soak liquid can then drain from the strainer 120 into the container 121, all of which can be accomplished without the user actually being required to touch or manipulate the items in the strainer 120. Once properly located, the strainer 120 can remain in the raised drainage condition for as long as desired, counterbalanced by the weight of soak liquid in the container 121. The spent soak liquid can then be emptied from the container 121 using the drain port 141.

As mentioned, the abutment surface may be substantially planar or arcuate, as illustrated.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

The invention claimed is:

1. An integrated strainer and container comprising:

a) a strainer with a plurality of openings in at least one wall thereof and at least one container engagement adapted to engage a container when the strainer is in a raised drainage position;

b) a container for holding a liquid and having an open top, configured to receive the strainer within the container, in a lower position, the container having an upper structure configured to engage at the least one container engagement to hold the strainer relative to the upper structure in a raised, drainage position; and c) wherein the strainer has two opposed side walls at least one of the side walls has a lower side wall portion and an upper side wall portion and the at least one engagement is provided on said at least one sidewall externally between the lower side wall portion and the upper side wall portion; and d) wherein the at least one container engagement is configured as an inverted U-shaped portion defining an opening configured to receive the upper structure of the container when the strainer is moved sideways into the raised drainage position.

2. An integrated strainer and container as claimed in claim 1 wherein the strainer and the container for holding the liquid are both generally frustopyramidal in shape with a pair of spaced apart end walls that converge downwardly and a pair of spaced apart side walls which converge downwardly and a base wall.

3. An integrated strainer and container as claimed in claim 1 wherein the strainer has two opposed side walls which have a lower side wall portion and an upper side wall portion separated by a laterally extending step to form a strainer with an upper portion which is larger in dimension than a lower portion of the strainer.

4. An integrated strainer and container as claimed in claim 1 wherein the strainer has opposed side walls and a container engagement provided on each of the opposed side walls so that the raised position may be on either side of the container.

5. An integrated strainer and container according to claim 1 wherein the strainer has two opposed side walls which have a lower side wall portion and an upper side wall portion separated by a laterally extending step to form a strainer with an upper portion which is larger in dimension than a lower portion of the strainer and further wherein the step is provided on an inside of the strainer and the engagement comprises at least one engagement provided externally and associated with the step.

6. An integrated strainer and container as claimed in claim 1 wherein the strainer and the container for holding the liquid are both generally frustopyramidal in shape with a pair of spaced apart end walls that converge downwardly and a pair of spaced apart side walls which converge downwardly and a base wall and further wherein the base wall of the strainer is provided with at least one engagement portion to engage with a corresponding portion provided on the container.

7. An integrated strainer and container as claimed in claim 6 wherein the at least one engagement portion of the base wall of the strainer is spaced inwardly from one of the sidewalls of the strainer.

8. An integrated strainer and container as claimed in claim 6 wherein each at least one engagement portion is or includes an opening into the base wall from a lower side.

9. An integrated strainer and container as claimed in claim 6 wherein a number of spaced apart engagement portions are provided on both lateral sides of the base wall, each including a recess.

10. An integrated strainer and container as claimed in claim 1 wherein the strainer and container are arranged so that the strainer fits inside the container and they have respective opposed pairs of close fitting side walls, at least one of the said close fitting side walls of the container having the said upper structure configured to engage the strainer's container engagement when the strainer is in the raised position.

11. An integrated strainer and container as claimed in claim 1 wherein the at least one container engagement is an upper container engagement, the strainer and container are arranged so that the strainer fits inside the container and they have respective opposed pairs of close fitting side walls, at least one of the said close fitting side walls of the container having the said upper structure configured to engage the strainer's upper container engagement when the strainer is in the raised position, at a lower location below the upper structure and the strainer's upper container engagement, the strainer having a second container engagement portion and the container having a strainer engagement portion corresponding to and cooperating with the second engagement portion at the lower location, the arrangement being that the upper structure, the upper container engagement, the strainer engagement portion of the container and the second container engagement portion engage in concert to hold the strainer in the raised position.

12. An integrated strainer and container as claimed in claim 1 wherein the at least one container engagement is an upper container engagement, the strainer and container are arranged so that the strainer fits inside the container and they have respective opposed pairs of close fitting side walls, at least one of the said close fitting side walls of the container having the said upper structure configured to engage the strainer's upper container engagement when the strainer is in the raised position, at a lower location below the upper structure and the strainer's upper container engagement, the strainer having a second container engagement portion and the container having a strainer engagement portion corresponding to and cooperating with the second engagement portion at the lower location, the arrangement being that the upper structure, the upper container engagement, and the strainer engagement portion of the container and the second container engagement portion engage in concert to hold the strainer in the raised position, the second container engagement portion comprising spaced recesses and the strainer engagement portion comprising spaced engagement extensions adapted to pass through the spaced recesses.

13. An integrated strainer and container as claimed in claim 1 wherein the at least one container engagement is an upper container engagement, the strainer and container are arranged so that the strainer fits inside the container and they have respective opposed pairs of close fitting side walls, at least one of the said close fitting side walls of the container having the said upper structure configured to engage the strainer's upper container engagement when the strainer is in the raised position, at a lower location below the upper structure and the strainer's upper container engagement, the strainer having a second container engagement portion and the container having a strainer engagement portion corresponding to and cooperating with the second engagement portion at the lower location, the arrangement being that the upper structure, the upper container engagement, the strainer engagement portion of the container and the second container engagement portion engage in concert to hold the strainer in the raised position so the strainer is suspended and effectively cantilevered from one side wall of the container.

14. An integrated strainer and container as claimed in claim 1 wherein the container has sump and drainage outlet.

15. An integrated strainer and container as claimed in claim 1 wherein the strainer has a base wall and the openings in the at least one wall are confined to the base wall and the lower side wall portion.

* * * * *